US008966865B2

(12) United States Patent
Widitora et al.

(10) Patent No.: US 8,966,865 B2
(45) Date of Patent: Mar. 3, 2015

(54) CAN END AND RELATED METHOD

(71) Applicant: Silgan Containers LLC, Woodland Hills, CA (US)

(72) Inventors: Alvin Widitora, Los Angeles, CA (US); Donald M. Gust, Oconomowoc, WI (US); Gerald J. Baker, Wauwatosa, WI (US)

(73) Assignee: Silgan Containers LLC, Woodland Hills, CA (US)

( * ) Notice: Subject to any disclaimer, the term of this patent is extended or adjusted under 35 U.S.C. 154(b) by 66 days.

(21) Appl. No.: 13/801,115

(22) Filed: Mar. 13, 2013

(65) Prior Publication Data

US 2014/0008365 A1 Jan. 9, 2014

Related U.S. Application Data

(60) Provisional application No. 61/669,365, filed on Jul. 9, 2012.

(51) Int. Cl.

| | |
|---|---|
| ***B65B 61/18*** | (2006.01) |
| ***B65D 17/00*** | (2006.01) |
| ***B21D 21/00*** | (2006.01) |
| ***B21D 51/38*** | (2006.01) |

(52) U.S. Cl.

CPC ..... *B65D 17/16* (2013.01); *B21D 21/00* (2013.01); *B65B 61/184* (2013.01); *B65D 17/165* (2013.01); *B65D 2517/0014* (2013.01); *B21D 51/383* (2013.01)

USPC ..... 53/412; 53/440; 53/471; 53/486; 220/269

(58) Field of Classification Search

CPC .. B65B 7/2857; B65B 61/184; B21D 51/383; B65D 2517/0014; B65D 17/165

USPC ..... 53/412, 440, 471, 486; 413/2; 220/269

See application file for complete search history.

(56) References Cited

U.S. PATENT DOCUMENTS

| | | | | |
|---|---|---|---|---|
| 2,029,329 | A | 2/1936 | Ljungstrom et al. | |
| 3,322,295 | A * | 5/1967 | Jones et al. | 220/273 |
| 3,622,055 | A * | 11/1971 | Douty | 220/269 |
| 4,253,582 | A * | 3/1981 | Shields | 220/269 |
| 4,576,304 | A * | 3/1986 | Henning | 220/269 |
| 5,804,237 | A * | 9/1998 | Diamond et al. | 53/440 |
| 8,695,832 | B2 * | 4/2014 | Thielen et al. | 220/270 |
| 2010/0326281 | A1 * | 12/2010 | Nishibe et al. | 220/269 |

FOREIGN PATENT DOCUMENTS

DE 102010013531 A1 * 10/2011

* cited by examiner

*Primary Examiner* — Stephen F Gerrity

(74) *Attorney, Agent, or Firm* — Reinhart Boerner Van Deuren s.c.

(57) ABSTRACT

A can end and a tab configured to couple to the can end and a related method are provided. The can end is continuous. The tab is configured to couple to the can end with a post, which couples the tab to the can end without passing through the can end.

7 Claims, 9 Drawing Sheets

CAN END AND RELATED METHOD

CROSS-REFERENCE TO RELATED PATENT APPLICATION

This application claims the benefit of U.S. Provisional Application No. 61/669,365, filed Jul. 9, 2012, which is incorporated herein by reference in its entirety.

BACKGROUND OF THE INVENTION

The present invention relates generally to the field of cans, can ends, and methods for delivering can ends and sealing cans. The present invention relates specifically to continuous can ends and tabs to be coupled thereto.

Cans are filled with products, such as foodstuffs, beverages, other liquids, etc. The products may be brought to the point of being commercially sterilized or "shelf stable" while in cans. During such a process, the required heat and pressure may be delivered by a pressurized heating device or retort system.

SUMMARY OF THE INVENTION

One embodiment of the invention relates to a method for improving the fitting and closing of a metal can. The method includes the step of delivering to a user a can end having an outer periphery configured to be coupled with a sidewall of a can. The can end includes a line of weakness located radially inwardly from the outer periphery. The can end includes a well located radially inwardly from the line of weakness. The well has a sidewall, including a non-circular portion and a bottom wall. The can end is continuous. The method also includes the step of delivering to the user a tab and a post, the tab having a first side and a second side opposite the first side. The first side is configured to be engaged at a first portion. The tab includes a second portion spaced apart from the first portion and configured to rupture the can end at the line of weakness. The post is located between the first portion and the second portion of the tab and extending from the first side of the tab. The post has a non-circular cross-section matching the non-circular portion of the sidewall of the well such that the tab is inhibited from rotating relative to the can end when the post is engaged with the can end. The user can attach the can end to a filled can and the tab is attached to the can end via the post and non-circular portion after the can is filled.

Another embodiment of the invention relates to a method of filling a can having a sidewall defining a can interior compartment. The method includes the step of placing a product in the interior compartment. The method also includes the step of providing a can end having an outer periphery and a weakened portion extending around at least a portion of the can end radially inwardly from the outer periphery. The can end also includes a depression and a well located between the depression and the weakened portion. The well includes a sidewall having a non-circular portion and a bottom wall. The end is continuous. The method also includes the step of coupling the can end to the sidewall of the can thereby sealing the interior compartment of the can. The method also includes the step of heating the contents in the can. The method also includes the step of providing a tab and a post. The post extends from the tab. The post includes a non-circular cross-section and includes a retaining feature distal from the tab. The method also includes the step of after putting the can through the heating step, placing the post in the well, coupling the tab to the can end, without the post passing through the can end, with the tab and the can end being rotationally fixed relative to one another.

Another embodiment of the invention relates to a method of improving the ease of opening a can end. The method includes the step of providing a can end configured to be coupled with the sidewall of a can. The can end includes a well located radially inward from the radial periphery of the can end. The well has a sidewall, including a non-circular portion, and a bottom wall. The can end is continuous. The method includes the step of providing a tab and a post, the tab having a first side and a second side opposite the first side. The first side is configured to be engaged by a user at a first portion. The tab includes a second portion spaced apart from the first portion and configured to rupture the can end. The post is located between the first portion and the second portion. The first portion extends at an angle of at least 105 degrees relative to the post. When the post is disposed in the well coupling the tab to the can end, a portion of the tab forms an angle of at least 15 degrees with the can end.

Another embodiment of the invention relates to a can. The can includes a sidewall. The can provides an interior compartment containing a product. The can includes a continuous can end including a periphery and a well located radially inwardly from the periphery. The well includes a sidewall. The sidewall includes a non-circular portion. The well also includes a bottom wall. The can end is coupled to the sidewall of the can sealing the can. The can also includes a tab with a post extending from the tab. The post has a non-circular cross-section. The post is located in the well of the can end coupling the tab to the can end. The non-circular portion of the sidewall of the well and the non-circular cross-section of the post inhibit rotation of the tab relative to the can end.

Alternative exemplary embodiments relate to other features and combinations of features as may be generally recited in the claims.

BRIEF DESCRIPTION OF THE DRAWINGS

The disclosure will become more fully understood from the following detailed description, taken in conjunction with the accompanying figures, wherein like reference numerals refer to like elements, in which.

DETAILED DESCRIPTION

Before turning to the figures, which illustrate the exemplary embodiments in detail, it should be understood that the present invention is not limited to the details or methodology set forth in the description or illustrated in the figures. It should also be understood that the terminology is for the purpose of description only and should not be regarded as limiting.

Generally, a can end is provided. The can end is configured to be coupled to a can that has been filled with a product, e.g., foodstuff, beverage, other liquid, etc., sealing the product within the can. Upon sealing the can with the can end, the can may be processed, such as, e.g., by a heating, cooking, and/or pressurizing device or retort system, etc. After undergoing such processing, e.g., retort, a tab, configured to facilitate opening the can end to obtain access to the product in the can, may be coupled to the can end by the user (e.g., the business that fills the can).

Figure 1:
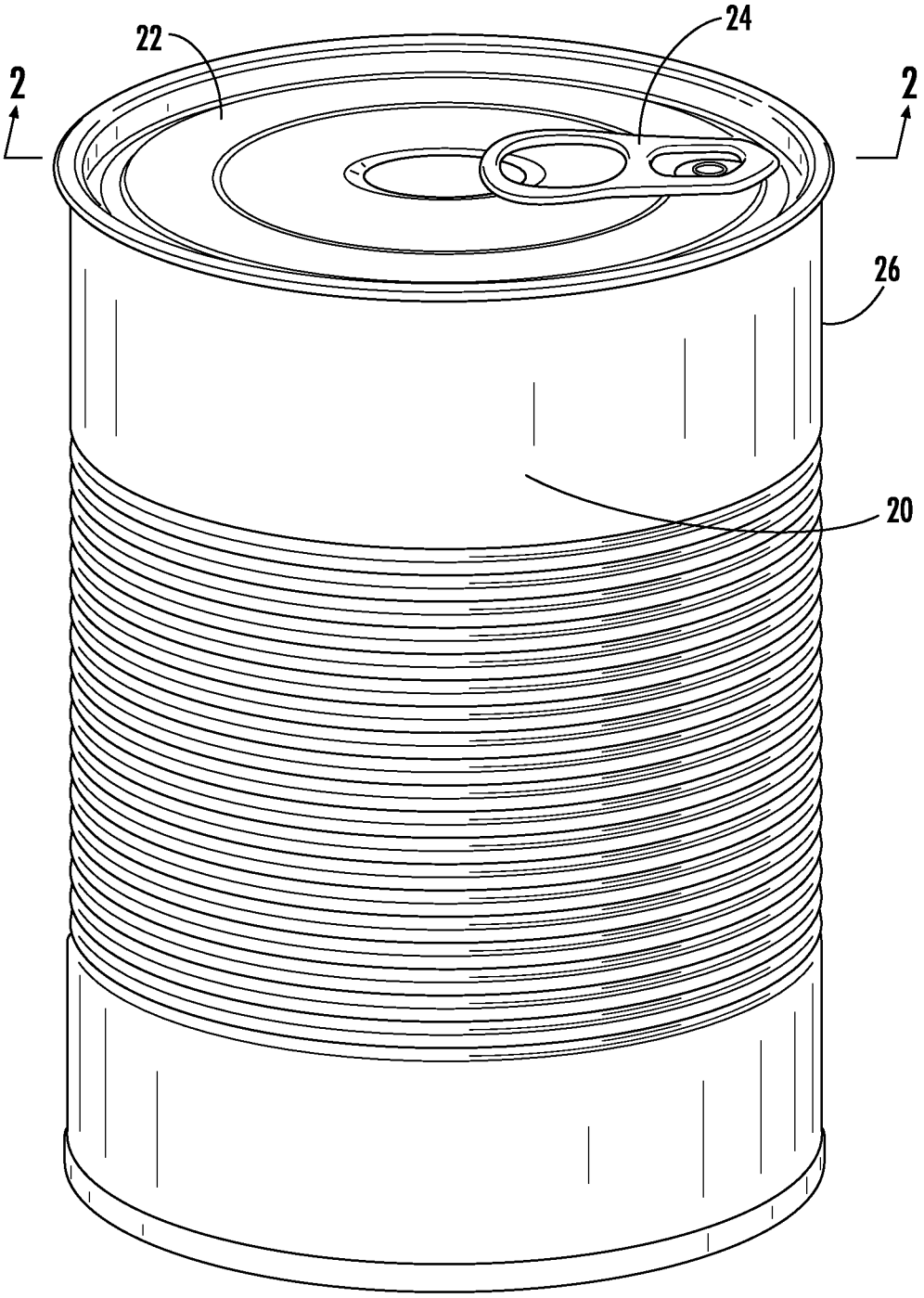
FIG. 1 is a perspective illustration of an embodiment of a tab coupled to an embodiment of a can end sealing an exemplary can.

Referring to the FIG. 1, a can 20, with a can end 22 coupled to the can 20, is illustrated. A tab 24 is coupled to the can end 22. The can end 22 is coupled, proximate its radial periphery, to the sidewall 26 of the can 20, such as, for example, by double-seaming. The can 20 illustrated is exemplary. The can end 22 may be provided to couple to and seal a variety of suitable cans.

Figure 2:
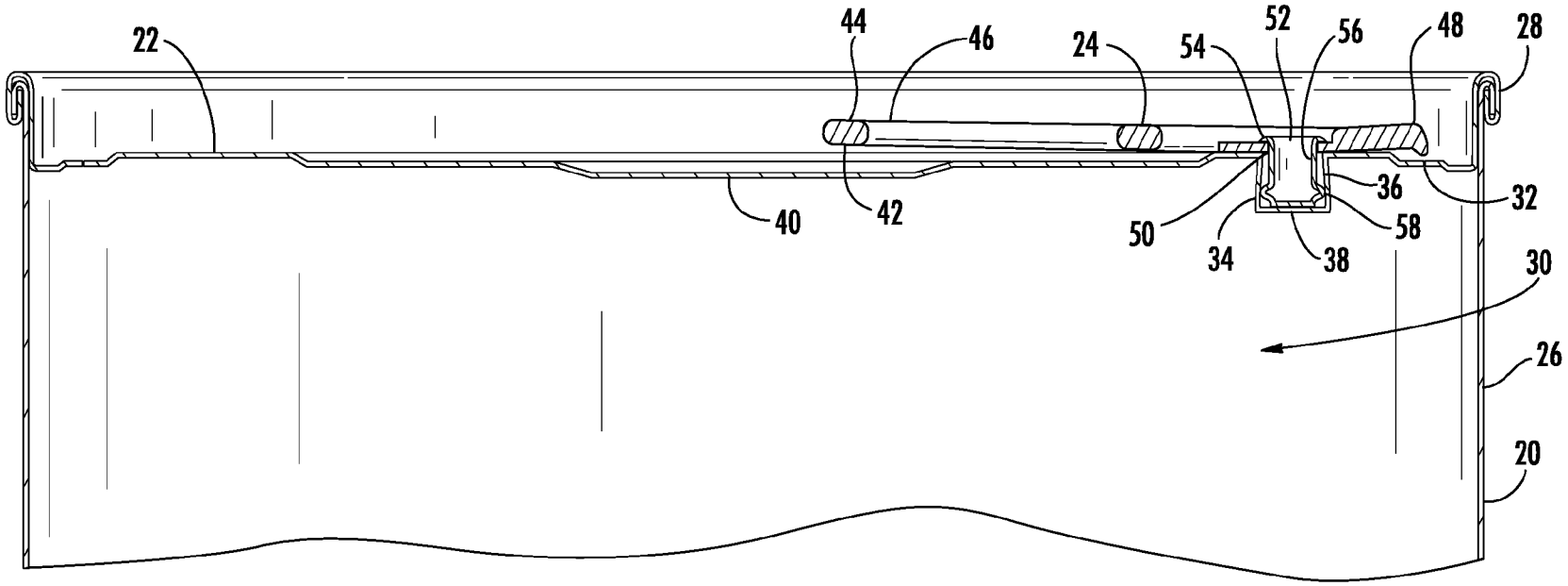
FIG. 2 is a cross-sectional view of the tab and the can end sealing the exemplary can of FIG. 1 taken along the line 2-2 in FIG. 1.
Figure 3:
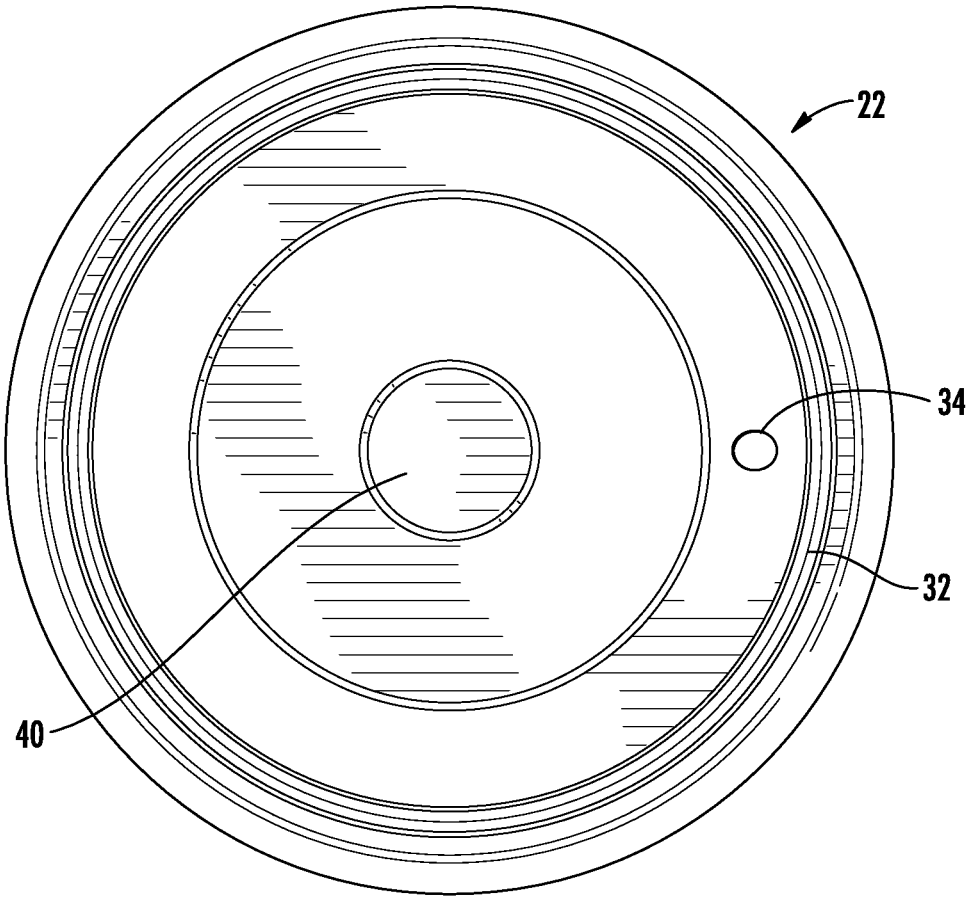
FIG. 3 is a top plan view of an embodiment of a can end.

FIG. 2 illustrates a cross-sectional view of the can end 22, tab 24, and can 20. FIG. 3 provides a top plan view of the can end 22 without the tab 24. With reference to FIGS. 2 and 3, the can end 22 is double-seamed 28 to the sidewall 26 proximate the radial periphery of the can end 22, sealing the interior compartment 30 of the can 20. Radially inwardly from the double seam 28, the can end 22 provides a frangible portion, illustrated as a line of weakness 32, extending around the can end 22 radially inwardly from the double-seam 28.

Radially inwardly from the line of weakness 32, the can end 22 includes a well 34. The well 34 includes a sidewall 36 extending axially downwardly and terminating at a bottom wall 38. In one embodiment the sidewall 36 tapers inwardly from the bottom wall 38 towards the top surface of the can end 22. In another embodiment the sidewall 36 does not taper inwardly. Radially inwardly from the well 34, the can end 22 includes a depression 40. As is illustrated, the can end 22 extends continuously, i.e., without apertures. Thus, the can end 22 may be coupled, e.g., double seamed to the sidewall 26 of a can 20 and may seal the interior compartment 30 of the can 20, without a tab attached to the can end 22.

Figure 4:
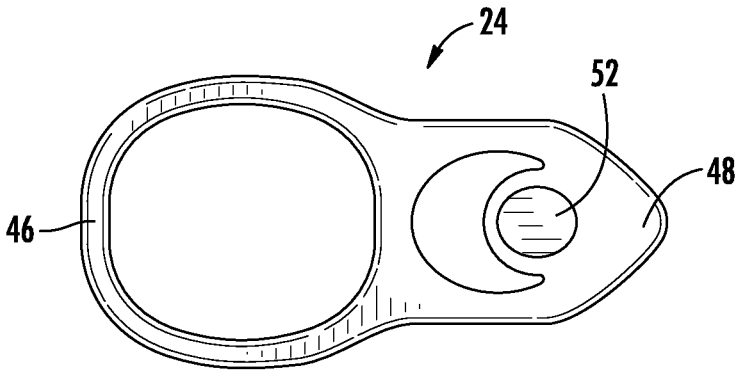
FIG. 4 is a top plan view of an embodiment of a tab.

FIG. 4 illustrates a top plan view of the tab 24 unattached to the can end 22. With reference to FIGS. 2 and 4, the tab 24 includes a first side 42 and a second side 44 opposite the first side 42. When the tab 24 is coupled with the can end 22, the first side 42 is proximate the can end 22 while the second side 44 is distal from the can end. The tab 24 also includes a first portion, illustrated as a ring portion 46, and a second portion, illustrated as a rupturing portion 48, coupled to the ring portion 46. Between the ring portion 46 and the rupturing portion 48, the tab 24 includes an aperture 50 in which a post 52 is configured to be received and retained. The post 52 includes a radially outwardly extending flange 54 which has a greater diameter than the aperture 50, rests on the surface of the tab 24, and retains the post 52 within the aperture 50. The post 52 also includes a sidewall 56 extending from the flange 54 through the aperture 50.

With reference to FIG. 2, a retaining feature is also provided, illustrated as a radially outwardly projecting ridge 58 extending around the circumference of the sidewall 56. The ridge 58 contacts the sidewall 36 of the well 34 and resists movement by the post 52 in the direction of withdrawing from the well 34.

With further reference to FIG. 2, when the post 52 is located in the well 34, a portion of the ring portion 46 is located over the depression 40 of the can end 22. This provides access to the first side 42 of the tab 24. Thus, a force may be applied to the first side 42 at the ring portion 46 tending to pivot the tab 24 about the well 34. As this force is applied, the rupturing portion 48 of the tab 24 is displaced towards the line of weakness 32 in the can end 22, and, as the tab 24 continues to be pivoted, the rupturing portion 48 will rupture the can end 22 at the line of weakness 32, and the can end 22 may be peeled back providing access to the interior 30 of the can 20 and product contained therein.

Providing easy access to the first side 42 of the tab 24 may be useful to allow convenient engagement of the first side 42 of the tab 24 and opening of the can 20 by a consumer. However, upon sealing of a can with a can end, the can undergoes various handling and processing by machinery, e.g., heating process, retort, etc. Tabs that project away from the surface of a can end may tend to interfere with the processing machinery, interrupting processing.

However, because the present embodiment of tab 24 is coupled with the can end 22 after processing/retort, as will be further described below, the tab 24 may project away from the can end 22 without interfering with the processing machinery. A retort process/system heats the sealed contents of a can to provide one or more objectives such as cooking, pasteurizing, flavor enhancement, etc.

As illustrated in FIG. 3, the well 34, and more particularly the sidewall 36 of the well 34, has a non-circular cross-section, illustrated as an elliptical, non-circular cross-section. As illustrated in FIG. 4, similarly, the post 52, and more particularly the sidewall 56 of the post, has a non-circular cross-section, illustrated as an elliptical, non-circular cross-section, matching the elliptical, non-circular cross-section of the sidewall 36 of the well 34, as illustrated in FIGS. 2-4. Thus, when the post 52 is located in the well 34, the post 52 and the well 34, and therefore the tab 24 and the can end 22, are inhibited from rotating relative to one another.

Figure 5:
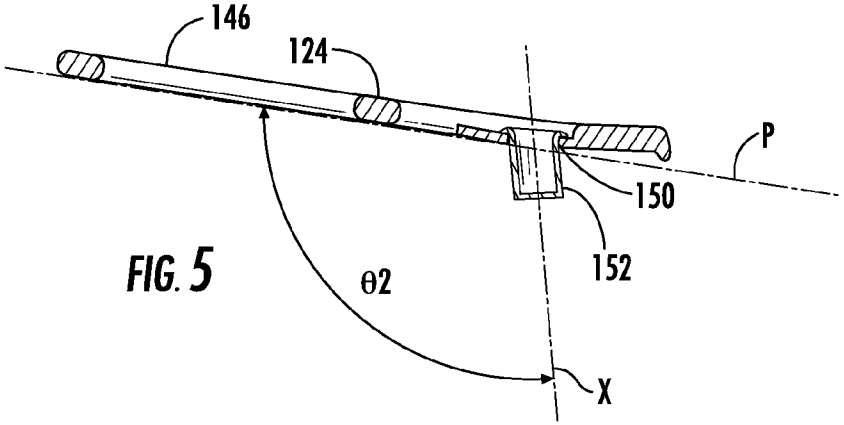
FIG. 5 is a cross-sectional view of a second embodiment of a tab and a post.
Figure 6:
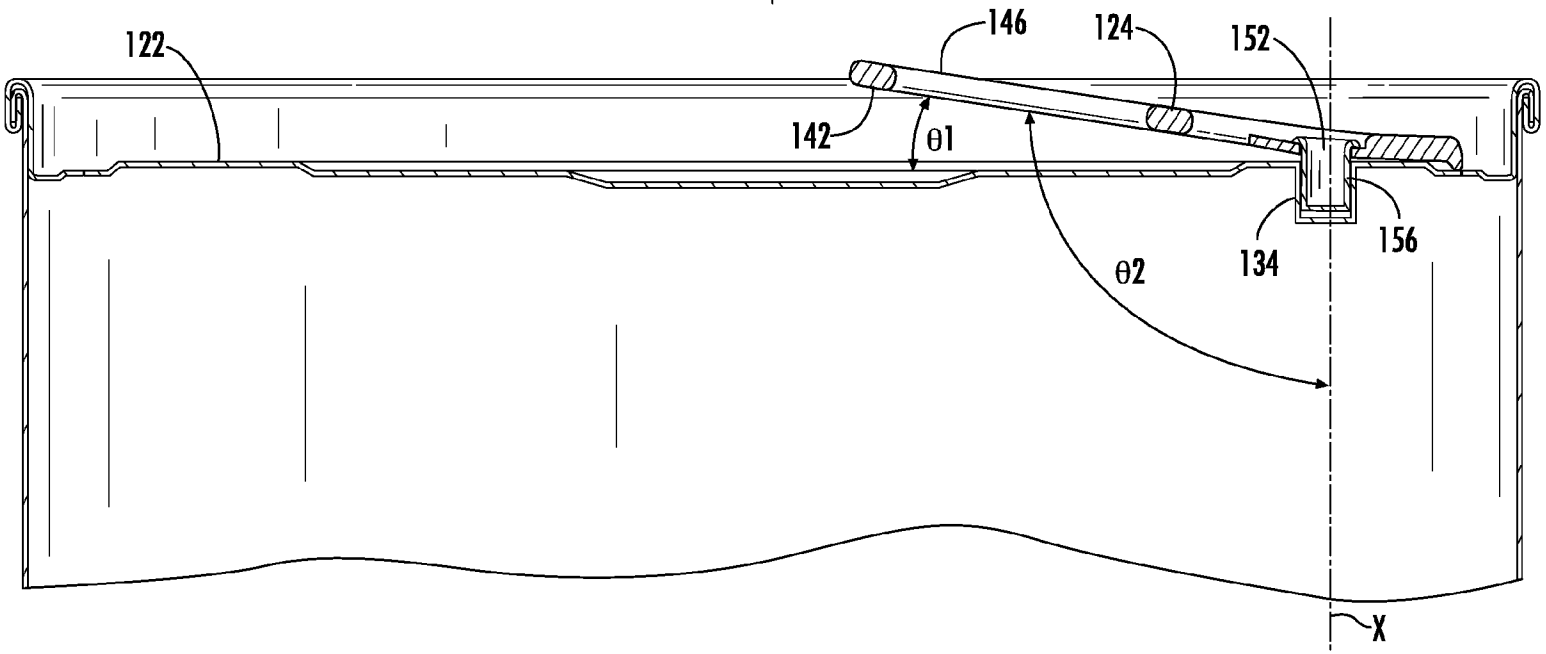
FIG. 6 is a cross-sectional view of the tab and the post of FIG. 5 coupled with a can end.

FIG. 5 illustrates a second embodiment of a tab 124. With reference to FIGS. 5 and 6, the configuration of the post 152 relative to the tab 124 configures the ring portion 146 to extend forming an angle $\theta 1$ with the can end 122 when the post 152 is located in the well 134 of the can end 122. In one embodiment $\theta 1$ is between approximately 1 degree and 35 degrees. In another embodiment $\theta 1$ is between approximately 10 degrees and 20 degrees. In another embodiment $\theta 1$ is at least approximately 15 degrees. This allows easy access to the first side 142 of the tab 124 to pivot the tab 124 about the well 134 to rupture the can end 122.

The ring portion 146 of the tab 124 lies in a plane P. The post 152 extends non-perpendicularly to the plane P from the aperture 150 and forms an angle of more than 90 degrees with the plane P. The sidewall 156 of the post 152 surrounds an axis X. In one embodiment, the angle $\theta 2$ between the axis X and the ring portion 146 of the tab 124 is between approximately 91 degrees and 125 degrees. In another embodiment, the ring portion 146 of the tab 124 forms an angle $\theta 2$ with the axis X of between approximately 100 degrees and 110 degrees. In another embodiment, the ring portion 146 of the tab 124 forms an angle $\theta 2$ with the axis X of at least approximately 105 degrees.

As in the previously described embodiment, in one embodiment, the post 152 has a non-circular cross-section, matching the non-circular cross-section portion of the well 134, thus inhibiting rotation of the post 152 relative to the well 134, and thus the tab 124 relative to the can end 122. Although the post 152 is illustrated without a retaining feature, in other embodiments, the post 152 (and/or the can end 122) includes a retaining feature, such as the retaining feature of the previously described embodiment.

Figure 7:
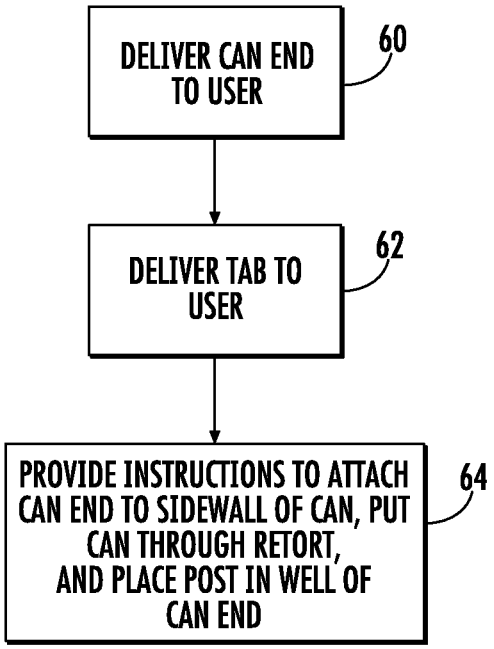
FIG. 7 is a block diagram of an embodiment of a method of improving the fitting and closing of a metal can.
Figure 8:
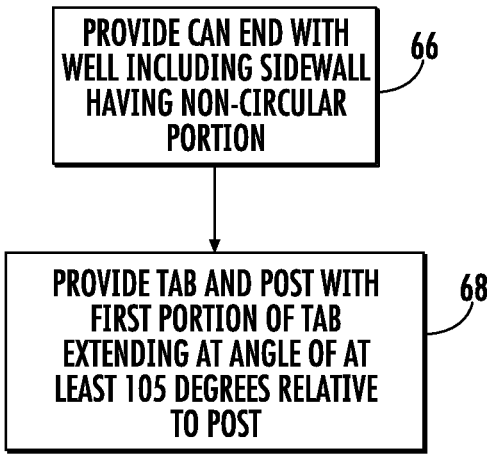
FIG. 8 is a block diagram of an embodiment of a method of delivering a can end.
Figure 9:
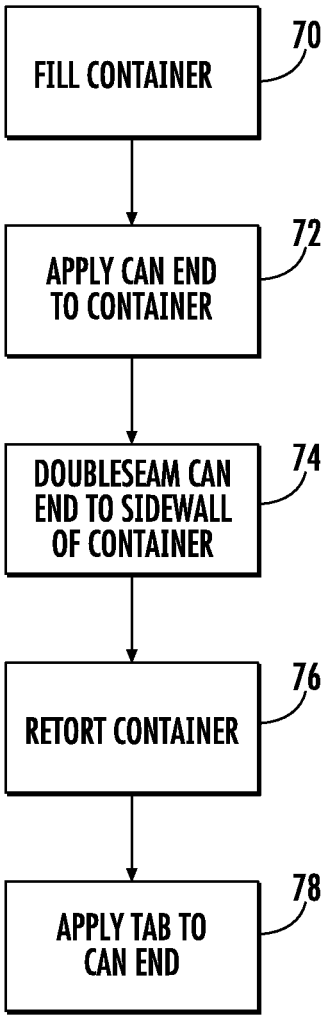
FIG. 9 is a block diagram of an embodiment of a method of filling a can.

With reference to FIGS. 7-9, block diagrams illustrating embodiments of methods of improving the fitting and closing of a metal can, improving the ease of opening a can end, and filling a can respectively are illustrated. As shown in FIG. 7, the illustrated method of improving the fitting and closing of a metal can includes the step of delivering to a user a can end 60, such as the can end 22. The method also includes the step of delivering to a user a tab 62, such as the tab 24. The user may be the same person or entity as makes the can end and tab or may be a different person or entity than makes the can end and tab. Additionally, the user may any other party that seals cans and/or couples can ends to cans. The can end and tab may be packaged and/or delivered separately or may be housed in the same packaging and delivered together. The method also includes step 64 of providing instructions to attach the can end 22 to a sidewall of a can, to heat the contents in the can, shown in FIG. 7 as putting the can through retort, and to subsequently place the post 52 of the tab 24 in the well of the can end 22. The instructions may be provided in any suitable form, including written, electronic, verbal, etc. Additionally, the instructions may be provided before delivering the can end and/or the tab, with the can end and/or tab, or after delivering the can end and/or tab.

FIG. 8 is a block diagram of an embodiment of a method of improving the ease of opening a can. As shown in FIG. 8, the method includes the step of providing a can end, such as, for example, the can end 22 or the can end 122, with a well including a sidewall having a non-circular portion 66. Additionally, the method includes the step 68 of providing a tab, such as, for example, the tab 124, and post, such as, for example, the post 152, which when configured together, a first portion of the tab extends at an angle of at least 105 degrees relative to the post. The can end, tab, and post, may be packaged and/or provided separately or together. Additionally, in one embodiment, the tab and post may be provided coupled together, with the first portion of the tab extending at an angle of at least 105 degrees relative to the post.

FIG. 9 is a block diagram of an embodiment of a method of filling a can. The method includes the step of filling a container 70, such as a metal can, with a product such as, for example, a food product, a beverage product, other liquid, etc. The method also includes the step of applying a can end, such as, for example, the can end 22 or the can end 122, to the container 72. The method also includes the step of double-seaming the can end to the sidewall of the container 74. The method also includes the step of heating the contents in the container, shown in FIG. 9 as retorting the container 76. The method also includes the step of applying a tab, such as, for example, the tab 24 or the tab 124, to the can end 78. In one embodiment, the tab is applied to the can end after the container is retorted.

Figure 10:
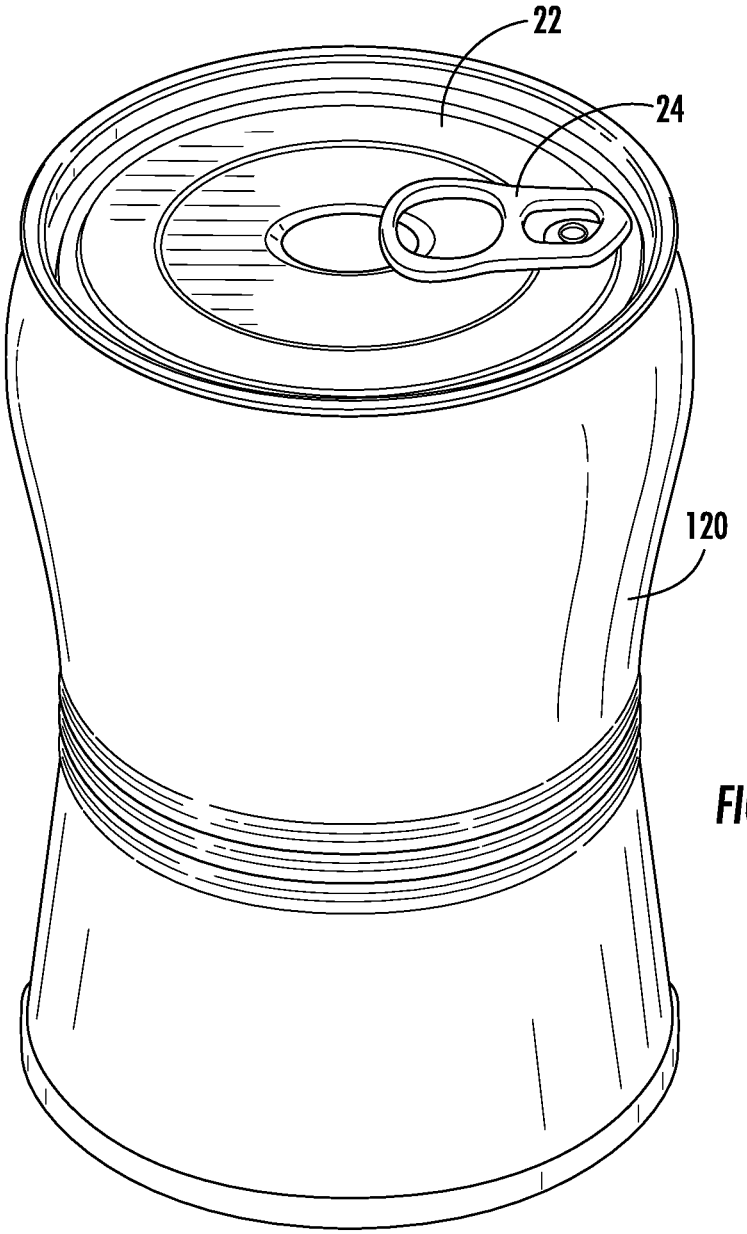
FIG. 10 is a perspective illustration of the tab coupled to the can end of FIG. 1, with the can end sealing an exemplary can with a non-cylindrical sidewall.

Embodiments of can ends 22 and 122 described herein may be applied to seal various types of containers and cans. For example, as illustrated in FIG. 10, the can end 22 may be applied to seal a non-cylindrical container 120 (i.e., a container whose sidewall generally has a varying diameter along its vertical axis).

In another embodiment, a continuous can end 222 is provided. The can end 222 includes a reinforcing bead feature 225. As in the previous embodiments, the can end 222 is a continuous can end, i.e., without apertures, and includes a well (not shown in FIG. 11) into which a post 252 may be received to couple a tab 224 to the can end 222. As such, this can end 222, as with previous embodiments, may be coupled to and seal a container, which may be retorted or otherwise processed, and then the tab 224 may be coupled with the can end 222 after the retort process. In the illustrated embodiment, the post 252 has a non-circular cross-section, illustrated as a rectangular cross-section, such that when the post 252 is located in the well (not visible in FIG. 11) of the can end 222, the tab 224 is inhibited from rotating relative to the can end 222.

Figure 11:
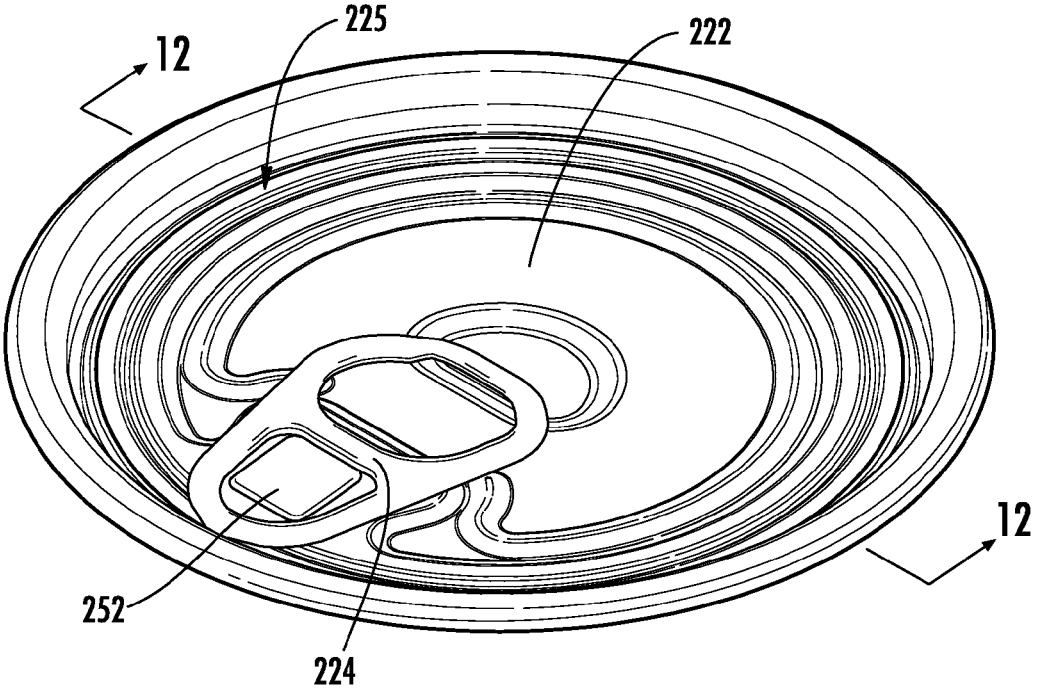
FIG. 11 is a perspective illustration of a third embodiment of a can end and a tab.
Figure 12:
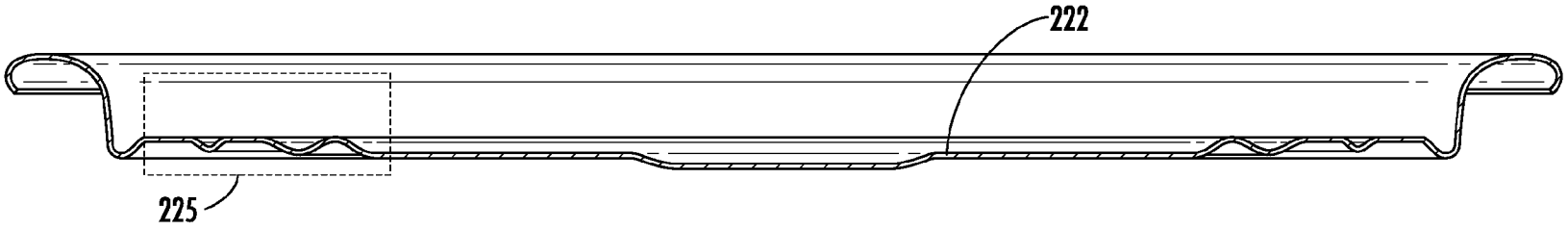
FIG. 12 is a cross-sectional view of the can end of FIG. 11 taken along the line 12-12 in FIG. 11.

With reference to FIG. 12, a cross-sectional view, taken along the line 12-12 in FIG. 11, of the can end 222 is illustrated, illustrating the reinforcing bead feature 225.

Can ends in accordance with embodiments of the present invention may include various additional features (e.g., the reinforcing bead feature of the can end illustrated in FIG. 12, other beading structures, etc.).

In one embodiment, the can end 20 may be coupled to the sidewall 22 of the can 24 by double-seaming the can end 20 proximate its periphery to the sidewall 22 of the can 24. In one embodiment, the can end 20 and the sidewall 22 of the can 24 are formed from metal (e.g., steel, aluminum, etc.). The metal of the can end 20 and the metal of the sidewall 22 are rolled, folded, or otherwise interlocked together and crimped, thereby coupling the can end 20 to the sidewall 22 and sealing the interior compartment 30 of the can 24. See, e.g., FIG. 2. In one embodiment, the end of the can distal from the can end 22, e.g., by double-seaming a blank can end (i.e., a can end without any mechanism for opening) to the sidewall 26, sealing the interior compartment 30 of the can 24. In other embodiments, the end of the can distal from the can end 22 may be sealed by any other suitable mechanism.

For purposes of this disclosure, non-circular means any cross-sectional shape that when the cross-section of the sidewall of the post and the cross-section of the portion of the sidewall of the well that are engaged have such a shape, they (and thus the tab and can end) are inhibited from rotating relative to one another. Examples include oval, ellipse, and other non-circular shapes, triangles, rectangles, regular and irregular polygons, etc.

In one embodiment, the line of weakness 32 is a score line, formed by any suitable mechanism, in the can end 20. In other embodiments, the line of weakness 32 may be any other suitable type of weakened area formed by any suitable mechanism suitable for breaking of the can end 20 by a tab. In one embodiment, the line of weakness 32 extends completely around the can end 20. In another embodiment, the line of weakness 32 extends around only a portion of the can end 20.

The can end 20 and the can 24 may each be formed from any suitable metal, plastic, combinations thereof, or any other suitable material.

The tab 24 and the post 52 may each be formed from any suitable metal, plastic, combinations thereof, or any other suitable material.

While the retaining feature is illustrated as a radially outwardly extending ridge, in other embodiments, other retaining features may be used to retain posts in wells of can ends, e.g., flexible retaining deflectors that allow deflection in one direction, e.g., as the post is inserted into the well, but that resist deflection in the opposite direction, e.g., if it is attempted to remove the post from the well. Additionally, in another embodiment, the upper edge of the well of the can end includes a retaining feature configured to allow the post to enter the well, but configured not to allow the post to be withdrawn from the well. In one embodiment, the can end includes a retaining feature, while the post does not include a retaining feature. In another embodiment the post includes a retaining feature, while the can end does not include a retaining feature. In another embodiment, both the can end and the post include retaining features.

Further modifications and alternative embodiments of various aspects of the invention will be apparent to those skilled in the art in view of this description. Accordingly, this description is to be construed as illustrative only. The construction and arrangements, shown in the various exemplary embodiments, are illustrative only. While the current application recites particular combinations of features in the various embodiments discussed herein, various embodiments of the invention relate to any combination of any of the features described herein, and any such combination of features may be claimed in this or future applications. Any of the features, elements, or components of any of the exemplary embodiments discussed above may be claimed alone or in combination with any of the features, elements, or components of any of the other embodiments discussed above.

Although only a few embodiments have been described in detail in this disclosure, many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein. In various exemplary embodiments, the relative dimensions, including angles, lengths and radii, as shown in the Figures are to scale. Actual measurements of the Figures will disclose relative dimensions and angles of the various exemplary embodiments. Various exemplary embodiments include any combination of one or more relative dimensions or angles that may be determined from the Figures. Further, actual dimensions not expressly set out in this description can be determined by using the ratios of dimensions measured in the Figures in combination with the express dimensions set out in this description. Some elements shown as integrally formed may be constructed of multiple parts or elements, the position of elements may be reversed or otherwise varied, and the nature or number of discrete elements or positions may be altered or varied. Other substitutions, modifications, changes and omissions may also be made in the design, operating conditions and arrangement of the various exemplary embodiments without departing from the scope of the present invention.

What is claimed is:

1. A method of filling a can having a sidewall defining a can interior compartment, the method comprising the steps of:

placing a product in the interior compartment;

providing a can end having an outer periphery and a weakened portion extending around at least a portion of the can end radially inward from the outer periphery, a depression, and a well located between the depression and the weakened portion, the well including a sidewall, having a non-circular portion, and a bottom wall, the end being continuous;

coupling the can end to the sidewall of the can thereby sealing the interior compartment of the can;

heating the product in the can;

providing a tab and a post, the post extending from the tab, the post having a non-circular cross-section and including a retaining feature distal from the tab;

after putting the can through the heating step, placing the post in the well, coupling the tab to the can end, without the post passing through the can end, with the tab and the can end being rotationally fixed relative to one another.

2. The method of filling a can of claim 1, wherein the non-circular cross-section of the post matches the non-circular portion of the sidewall of the well.

3. The method of filling a can of claim 1, wherein the tab includes a ring portion configured to be utilized by a user to pivot the tab about the well and a rupturing portion coupled to the ring portion and configured to rupture the line of weakness of the can end when the tab is pivoted about the well.

4. The method of filling a can of claim 3, wherein at least a portion of the ring portion is located above the depression when the post is located in the well.

5. The method of filling a can of claim 3, wherein the ring portion and the end form between them an angle of at least 15 degrees.

6. The method of filling a can of claim 1, wherein the end is circularly shaped.

7. The method of filling a can of claim 1, wherein the sidewall of the can includes a portion that is non-circular when viewed in cross-section.

* * * * *